United States Patent [19]

Arendt

[11] 4,344,602

[45] Aug. 17, 1982

[54] LOCK OPEN MECHANISM FOR SUBSURFACE SAFETY VALVE

[75] Inventor: Henry P. Arendt, Dallas, Tex.

[73] Assignee: Otis Engineering Corporation, Dallas, Tex.

[21] Appl. No.: 197,669

[22] Filed: Oct. 16, 1980

[51] Int. Cl.[3] ..... E21B 43/12

[52] U.S. Cl. ..... 251/58; 166/323; 251/89

[58] Field of Search ..... 166/323; 251/58, 89, 251/90, 113

[56] References Cited

U.S. PATENT DOCUMENTS 3,696,868 10/1972 Taylor ..... 166/323 X 3,886,967 6/1975 Nelson ..... 166/323 X

*Primary Examiner*—Robert G. Nilson

*Attorney, Agent, or Firm*—Vinson & Elkins

[57] ABSTRACT

A subsurface safety valve for use in wells, preferably adapted for placement in a tubing string, having a lock open mechanism for temporarily maintaining the safety valve in the open to flow position. The safety valve includes a closure device, such as a rotatable ball, located in the flow passage of the valve and is opened and closed by a biased operator tube. The operator tube is movable in response to hydraulic fluid conducted to the safety valve operating on a piston carried on the operator tube. A shiftable sleeve and collet is positioned above the operator tube and has a profile for receiving a shifting tool. When shifted, the collet and sleeve act on the operator tube to hold the valve in the open to flow position. The collet engages a recess on the bore wall of the safety valve upon shifting, and the sleeve moves behind the engaged collet head to prevent unlocking. The safety valve can be returned to operation by shifting the sleeve and collet to their original, normal position.

11 Claims, 3 Drawing Figures

LOCK OPEN MECHANISM FOR SUBSURFACE SAFETY VALVE

BACKGROUND OF THE INVENTION

1. Field of the Invention

The invention is related to subsurface safety valves useful in wells. More particularly, the invention relates to a mechanism for either the permanent or temporary locking open of the closure device in a tubing retrievable subsurface safety valve.

2. Prior Art

In the oil and gas industry it is accepted practice to use safety valves positioned within the well tubing for regulating the flow of well fluids from the producing formation to the surface of the well. This is a critical safety feature in the event there is some emergency situation in the well or at the surface of the well requiring termination of well fluid flow. Safety valves are placed in the well by either using setting methods to install well bore mounted safety valves or by connecting a safety valve in the tubing string itself. The latter are referred to as tubing retrievable subsurface safety valves.

It is often necessary to "lock" open the closure device which is in the safety valve. In the event the safety valve is malfunctioning it will be necessary to install a secondary safety valve, by either wireline or through the flow line techniques. It is not always necessary to permanently lock open the valve closure device. There are times when it is desired to only temporarily lock open the closure device and later be able to place the safety valve in operation.

It is an object of the present invention to provide a subsurface safety valve capable of being temporarily or permanently locked in the open to flow position.

A further object is to provide a tubing retrievable subsurface safety valve capable of being either temporarily or permanently locked in the open to flow position.

Another object of the invention is to provide a tubing retrievable subsurface safety valve capable of being either temporarily or permanently locked in the open to flow position using either wireline or through the flow line techniques.

The above and other objects and features of the invention will be apparent to those skilled in the art after a consideration of the following detailed description taken in conjunction with the accompanying drawings in which a preferred embodiment of the invention is shown.

DESCRIPTION OF THE PREFERRED EMBODIMENTS

Figure 1:
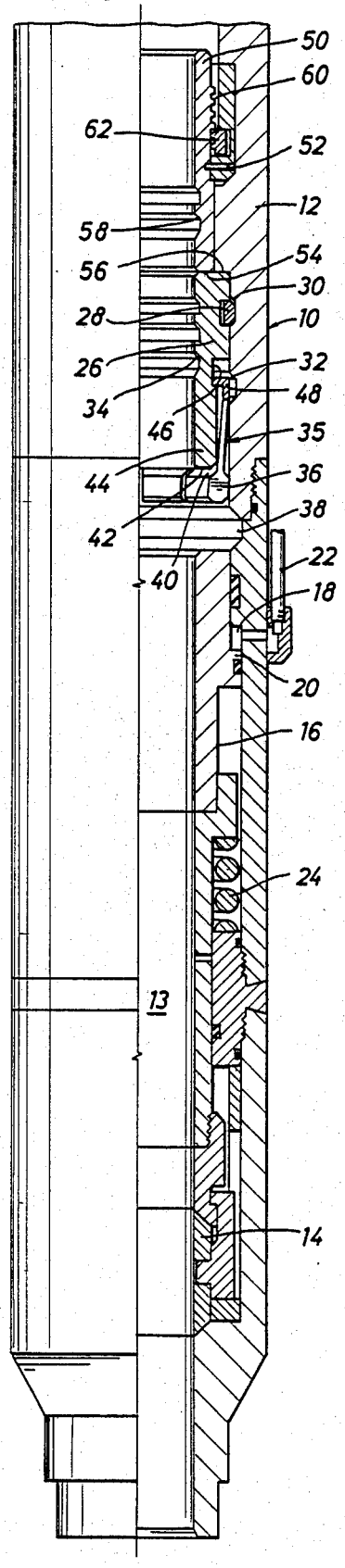
FIG. 1 is a plan, quarter sectional view of a portion of a tubing retrievable subsurface safety valve showing the lock open mechanism of the invention.
Figure 3:
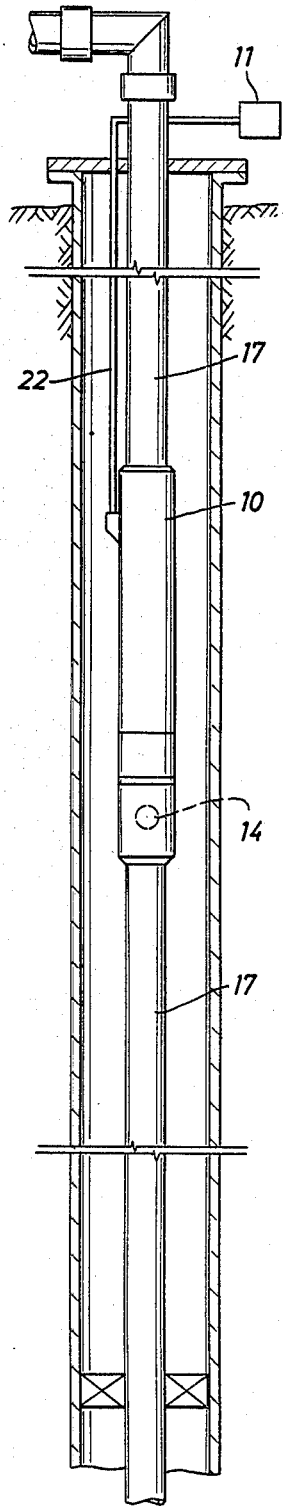
FIG. 3 is a schematic view of a well installation incorporating a tubing retrievable subsurface safety valve.

Referring to FIG. 1, one embodiment of the invention is shown in a tubing retrievable subsurface safety valve 10 having a tubular housing 12 connectable in a well tubing string, as illustrated in FIG. 3. Disposed within the housing 12 is a closure device 14, illustrated in the drawings to be a ball type closure device 14, well known in the industry. The ball 14 is shown to be in the open to flow position.

The safety valve 10 has a longitudinal bore flow passageway 13 which, when connected in the tubing string 17, as shown in FIG. 3, provides fluid communication through the safety valve to the well tubing string. Disposed within the housing bore 15 is a biased actuator 16, axially movable in response to hydraulic pressure fluid entering a variable capacity pressure chamber 18. Preferably, the pressure chamber 18 is positioned between the biased actuator 16 and the bore wall 15 of the tubular housing 12. There is provided means, preferably a piston member 20, carried on the actuator 16, which is responsive to the pressure exerted within the variable capacity pressure chamber 18, to cause the actuator to move in the direction of the closure device 14, causing same to be rotated to an open to flow position.

Hydraulic pressure fluid is usually transmitted to the safety valve 10 and its variable capacity pressure chamber 18 through suitable conduit 22, from a source 11 at the surface of the well. As long as sufficient pressure is applied, at the surface of the well, to the pressure fluid in conduit 22, the pressure in the variable capacity pressure chamber 18 will cause the actuator 16 to remain in the open to flow position, as seen in FIG. 1.

Release of pressure, however, allows the actuator 16 to return to the closed to flow position. The actuator 16 is biased by action of a resilient urging means, such as a spring member 24 acting on the actuator 16. The spring 24 biasing means should have sufficient spring force to urge the actuator 16 to its closed to flow position.

Figure 2:
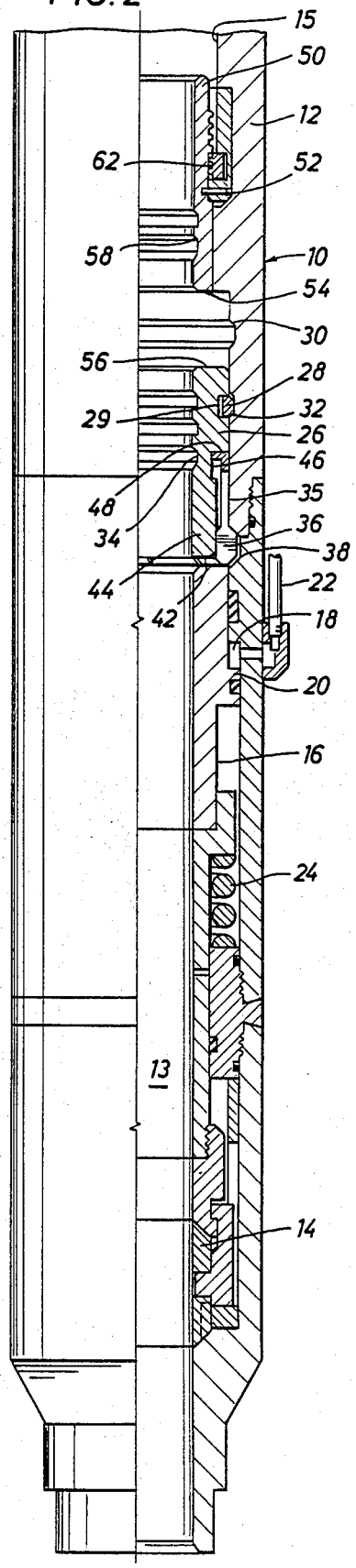
FIG. 2 is a plan, quarter sectional view of a portion of a tubing retrievable subsurface safety valve, showing the lock open mechanism temporarily holding the closure mechanism in an open to flow position.

It should be emphasized that the safety valve illustrated in FIGS. 1 and 2 are merely schematically representative of tubing retrievable subsurface safety valves and that there are many alternative features that are possible in such safety valves. The above operative description is done merely to illustrate the basic operation of virtually all of such safety valves known in the industry.

The particular improvement in such safety valves, to which this application is directed, resides in the combination of elements which make the novel mechanism for locking out the actuator 16 and closure device 14 to be either temporarily or permanently in the open to flow position upon release of pressurization acting upon the control fluid pressure responsive means.

Still referring to FIG. 1, it will be seen that there is positioned in the housing bore 15 a tubular sleeve 26 which is movable to a first position not acting on said actuator 16, and a second position (FIG. 2) acting on said actuator 16 to cause same to be held in the open to flow position. The sleeve 26 is retained in first and second positions by releasable retaining means, which is preferably a snap ring 28 carried by said sleeve 26. In the preferred embodiment of the invention, the snap ring 28 is retained in a recess 29 in the sleeve 26, whereby the snap ring 28 can be compressed within the recess 29, allowing the sleeve 26 to be shifted to its next position.

Of course, it is to be understood that the snap ring 28 or other retaining means may be reversed so that the snap ring is held by the tubular housing 12 and is received by comlimentary recesses in the sleeve 26.

However, in the embodiment illustrated, the snap ring 28 is engaged in a complimentary recess 30 in the bore wall 15 of the tubular housing 12. In this position, the sleeve 26 does not interfere with the normal hydraulic fluid pressure operation of the actuator 16.

Means 34 are provided on the sleeve 26 for receiving and housing a shifting tool, operable by either wireline or through the flow line (TFL) methods. Such shifting tools are well known in the art. A typical shifting tool, useful with the present invention, is manufactured and sold by Otis Engineering Corporation and is identified as either a 10XL or 42 EO shifting tool.

With the shifting tool engaged in the sleeve recesses 34, a downward force is applied to the sleeve to disengage the snap ring 28 from housing recess 30. A second, lower housing recess 32 is provided in the bore wall 15 of the tubular housing 12. When the sleeve 26 is moved downwardly by the shifting tool, to the position illustrated in FIG. 2, the snap ring engages the second housing recess 32.

Positioned between the sleeve 26 and the bore wall 15 of the housing 12 is a releasable housing engaging means 35, shiftable with the sleeve 26 for retaining the lockout means temporarily in its second position. Preferably, the engaging means is a collet member 35 having a plurality of heads 36. The collet member 35 is associated with the shiftable sleeve 26 in such a manner that the two move essentially as one unit. However, the upper portion 48 of the collet member 35 is engaged in a sleeve recess 46 which permits some axial movement of the sleeve 26 without corresponding movement of the collet member 35.

In FIG. 1, it is seen that when the sleeve 26 is in its first position, with the snap ring 28 engaged in the upper housing recess 30, the upper portion 48 of the collet member 35 is at the lower extremity of the sleeve recess 46. Enough room should be provided in the sleeve recess 46 to permit downward travel of the sleeve 26 relative to the collet member 35 to permit the lower end 44 of the sleeve 26 to move down to support the collet heads 36 out into the recess 38.

Force is applied to the collet member 35 by action of a shoulder 42, on the lower end 44 of the sleeve 26 contacting a matching shoulder 40 on the collet heads 36. When the collet member 35 and sleeve 26 are moved to its second position, by the shifting tool, the collet heads 36 reaches a position where it is received in a recess 38 in the bore wall 15 of the tubular housing 12. The collet heads 36, having been forced inward while in the sleeve 26 first position, naturally spring outward upon reaching the bore wall recess 38.

Continued downward movement of the sleeve 26 causes the sleeve lower member 44 to move past the collet head shoulder 40. The upper portion 48 of the collet member 35 moves to the upper end of the sleeve recess 46. The snap ring 28 will not engage in the second bore wall recess 32 until the sleeve 26 has moved to the full limit of travel, backing the collet heads 36 as shown in FIG. 2. With the collet heads 36 engaged in the recess 38, the operator member 16 is held down in its second position. However, it is important to note that the operator member 16 is held in this second position by the collet heads 36 being held in the recess 38 by the sleeve 26 (with the lower end 44 of the sleeve 26 engaged behind the collet heads 36).

In this position, the safety valve closure member 14 is in an open to flow position. Hydraulic fluid pressures can be terminated and the closure member 14 will remain in the open position. This locked open mode of the invention can be either permanent or temporary.

If temporary, the sleeve 26 can be engaged once again by the shifting tool and forced back to its first position (FIG. 1). Upward force applied on the sleeve 26 causes the snap ring 28 to disengage from the lower, second recess 32, allowing the sleeve 26 to move relative to the collet member 35 and from behind the collet heads 36. Continued upward force on the sleeve 26 causes the collet heads 36 to be retracted from the housing bore wall recess 38 and the collet member 35 to be moved upward along with the sleeve 26, to a point where the snap ring 28 engages the upper, first housing bore recess 30.

When the sleeve 26 is being moved upward from behind the collet heads 35, the shoulder configuration of the upper portion 48 of the collet member 35 engages the lower end of the sleeve recess 46 and insures that the collet member 35 is moved up, out of contact with the operator tube 16, as the sleeve 26 is moved to its fully up position. When the sleeve 26 is in its fully up position, the snap ring 28 is engaged with the bore wall recess 32.

A second lock out sleeve 50 may also be provided, to be used in combination with the first lock out sleeve 26, for permanently locking the safety valve 10 in an open to flow position.

Preferably, the second lock out sleeve 50 is positioned in the housing bore 15 as the uppermost member within the bore 15. In the embodiment shown in the drawings, the second sleeve 50 is positioned just above and juxtaposed to the first, temporary lock out sleeve 26. The second sleeve 50 is movable with a shifting tool, as previously described, operable by either wireline or TFL techniques, when engaged in profiles 58 in the sleeve bore wall.

A shear pin 52 or other suitable retaining means may be placed to retain the second sleeve 50 to the bore wall 15 of the tubular housing 12 until such time as it is desired to shift the sleeve 50 to its permanent lock out position (not shown). The second sleeve 50 is provided with one way threads 60 which are engageable with matching threads on suitable means, such as a snap ring 62, received and held by the housing bore wall 15.

When the force applied to the shifting tool causes the second sleeve 50 to shear the shear pin 52, the sleeve teeth 60 move to and engage the matching teeth of the snap ring 62. In this position, the lower edge 54 of the second sleeve abuts the upper edge 56 of the first sleeve 26. The interlocked teeth 60 and 62 will not allow the second sleeve 50 to be shifted upward, causing the safety valve 10 to be locked permanently in the open to flow position.

What is claimed is:

1. A subsurface safety valve comprising a tubular housing having a longitudinal bore extending therethrough defining a flow path, closure means disposed in said bore for controlling flow through said flow path, operator means longitudinally movable with respect to said tubular housing for moving said closure means and having a first position wherein said closure means closes said flow path and having a second position wherein said closure means opens said flow path, control fluid pressure responsive means for moving said operator means from said first position to said second position when affected by fluid pressurized above a selected value, biasing means for urging said operator means to move to its first position, lock out means disposed in said bore, shiftable to act on said operator means to temporarily hold said operator means in said second position upon release of pressurization acting upon said control fluid pressure responsive means, profile means on said lock out means for receiving a shifting tool, a permanent lock out sleeve above said lock out means, and latch means between said housing and said permanent lock out sleeve permitting downward movement while preventing upward movement of said sleeve, said permanent lock out sleeve movable downwardly into engagement with said lock out means to permanently hold said lock out means in a position to retain the operator means in said second position.

2. The subsurface safety valve of claim 1, wherein said lock out means comprises a sleeve, disposed in said bore, which is shiftable to a second position to act on said operator means to either temporarily or permanently hold said operator means in said second position, and which is shiftable to a first position in which said lock out means does not affect movement of said operator means, and releasable housing engaging means shiftable with said sleeve, for retaining said lock out means in its second position.

3. The subsurface safety valve of claim 2, wherein said lock out means is shiftable by means of a shifting tool received in said profile means and which causes said retaining means to release said lock out means for movement to an alternate position.

4. The subsurface safety valve of claim 1, wherein said lock out means comprises a shiftable tubular sleeve disposed in said bore above said operator means, profile means on said sleeve for receiving a shifting tool, a collet member, disposed between at least a portion of said sleeve and the bore wall of said tubular housing, movable with said sleeve to a first position at which said collet member is engageable with said tubular housing in order to act on said operator means to either temporarily or permanently hold said operator means in said second position.

5. A subsurface safety valve comprising a tubular housing, connectable in a well tubing string, having a longitudinal bore extending therethrough defining a flow path, closure means disposed in said bore for controlling flow through said flow path, operator means longitudinally movable with respect to said tubular housing for moving said closure means and having a first position wherein said closure means closes said flow path and having a second position wherein said closure means opens said flow path, piston means on said operator means responsive to control fluid pressure to cause said operator means to move from said first position to said second position when acted upon by control fluid pressurized above a selected value, biasing means for urging said operator means to move to its first position, a tubular lock out sleeve, disposed in said bore, having profile means thereon for receiving a shifting tool, a collet member carried by said lock out sleeve and movable axially with the sleeve and axially relative to the sleeve, an annular groove in said tubular housing, said collet member having collet heads which when retracted engage the lower end of the lock out sleeve to move the collet downwardly with the lock out sleeve to a position where said heads can move radially outwardly into said groove, said lock out sleeve in its full down position engaging said heads and holding them expanded and locked in said groove with said heads engaging and holding the operator means in valve open position.

6. The subsurface safety valve of claim 5, wherein said lock out sleeve and said collet member are shiftable by means of a shifting tool received in said profile means.

7. The subsurface safety valve of claim 6, including releasably retaining means for retaining said lock out sleeve in its second position.

8. A subsurface safety valve comprising a tubular housing, connectable in a well tubing string, having a longitudinal bore extending therethrough defining a flow path, closure means disposed in said bore for controlling flow through said flow path, operator means longitudinally movable with respect to said tubular housing for moving said closure means and having a first position wherein said closure means closes said flow path and having a second position wherein said closure means opens said flow path, piston means on said operator means responsive to control fluid pressure to cause said operator means to move from said first position to said second position when acted upon by control fluid pressurized above a selected value, biasing means for urging said operator means to move to its first position, a tubular lock out sleeve, disposed in said bore, which is shiftable to a second position to act on said operator means to either temporarily or permanently hold said operator means in said second position, and which is shiftable to a first position in which said lock out sleeve does not affect movement of said operator means, a collet member having a plurality of collet heads axially movable with said lock out sleeve and engageable with said tubular housing, which when shifted with said lock out sleeve to its second position contacts said operator means upon engagement of said collet heads with said tubular housing.

9. The subsurface safety valve of claim 8, including releasable retaining means carried by said lock out sleeve and engageable with said tubular housing for retaining said lock out sleeve in either its first or second position.

10. The subsurface safety valve of claim 9, wherein said lock out sleeve is movable to a position wherein said collet heads cannot be disengaged from said tubular housing.

11. The subsurface safety valve of claim 10, wherein said releasable retaining means is engageable with said tubular housing, for retaining said lock out sleeve in its second position, only when said lock out sleeve is moved to a position wherein said collet heads cannot be disengaged from said tubular housing.

* * * * *